US007086610B2

(12) United States Patent
Hubmann et al.

(10) Patent No.: US 7,086,610 B2
(45) Date of Patent: Aug. 8, 2006

(54) VENTED DISPENSER

(75) Inventors: Curtis H. Hubmann, Racine, WI (US); John A. Boticki, Racine, WI (US); Joseph K. Dodd, Lee's Summit, MO (US)

(73) Assignee: JohnsonDiversey, Inc., Sturtevent, WI (US)

( * ) Notice: Subject to any disclaimer, the term of this patent is extended or adjusted under 35 U.S.C. 154(b) by 0 days.

(21) Appl. No.: 10/876,056

(22) Filed: Jun. 24, 2004

(65) Prior Publication Data

US 2005/0284959 A1 Dec. 29, 2005

(51) Int. Cl.
*A62C 5/02* (2006.01)
*B05V 1/30* (2006.01)

(52) U.S. Cl. ..... 239/310; 302/318; 302/354; 302/361; 302/581.2

(58) Field of Classification Search ..... 239/310, 239/353, 354, 361, 367, 344, 302, 303, 407, 239/569, 581.2, 318, 311, 314, 315, 316, 239/335, 346, 365, 366, 124
See application file for complete search history.

(56) References Cited

U.S. PATENT DOCUMENTS

| | | | | |
|---|---|---|---|---|
| 1,638,550 A | | 8/1927 | Paasche | |
| 3,157,360 A | | 11/1964 | Heard | 239/354 |
| 3,763,888 A | * | 10/1973 | Duecker | 137/893 |
| 4,901,923 A | * | 2/1990 | McRoskey et al. | 239/123 |
| 4,993,602 A | | 2/1991 | Casey | 222/396 |
| 5,213,265 A | * | 5/1993 | Englhard et al. | 239/310 |
| 5,529,244 A | * | 6/1996 | Horvath et al. | 239/318 |
| 6,196,409 B1 | | 3/2001 | Lake et al. | 220/371 |
| 6,267,303 B1 | * | 7/2001 | Francis | 239/318 |
| 6,345,773 B1 | * | 2/2002 | Shanklin et al. | 239/318 |
| 6,378,785 B1 | * | 4/2002 | Dodd | 239/318 |
| 6,425,354 B1 | * | 7/2002 | Buchel et al. | 123/46 R |
| 6,708,901 B1 | | 3/2004 | Hubmann et al. | 239/310 |
| 6,749,133 B1 | * | 6/2004 | Ketcham et al. | 239/318 |
| 2002/0008161 A1 | | 1/2002 | Ketcham et al. | 239/310 |
| 2002/0092925 A1 | | 7/2002 | Hubmann et al. | 239/310 |

OTHER PUBLICATIONS

W.L. Gore & Associates GmbH, 2 page brochure on Gore Packaging Vents Molded Components, © 2003.
Saint-Gobain Calmar Assembly sheets (3 pages), Apr. 1, 2004.

* cited by examiner

*Primary Examiner*—David A. Scherbel
*Assistant Examiner*—Seth Barney
(74) *Attorney, Agent, or Firm*—Neil E. Hamilton; James J. Sales; Renee J. Rymarz

(57) ABSTRACT

A dispenser for dispensing different quantities of chemical concentrate into a stream of fluid from a concentrate container wherein the container has a pressure relief vent, and the dispenser provides an air vent when it is operated. In a preferred manner, the dispenser and cap are integrally connected with the pressure relief vent located in the cap. The dispenser is capable of dispensing a wide variety of chemical products with minimal concern for the type of chemical product and pressures generated in the container.

14 Claims, 10 Drawing Sheets

VENTED DISPENSER

CROSS-REFERENCES TO RELATED APPLICATIONS, IF ANY

None.

STATEMENT REGARDING FEDERALLY SPONSORED RESEARCH OR DEVELOPMENT

None.

BACKGROUND OF THE INVENTION

The field of the invention is dispensers for chemical concentrates, and particularly the dispensing of chemical concentrates, from a container, which can cause an increase in pressure in the container.

Dispensers of the type concerned with in this invention are disclosed in U.S. Pat. No. 6,708,901, which teachings are incorporated herein. The dispensing apparatus disclosed in this patent can control the flow of carrier liquid and chemical product in a precise and controlled manner. However, there are instances where the chemical product which is stored in the container from which the chemical product is dispensed can cause an increase in pressure. If the contents of the container are not vented, a problem can arise.

Vented type dispensers are disclosed in U.S. Pat. No. 1,638,550 and No. 3,157,360. Venting systems for containers are described in U.S. Pat. No. 4,993,602 and No. 6,196,409.

The prior art does not provide a venting of excess pressure from a container which is employed in conjunction with a dispenser employing an eductor. Neither does the prior art provide such a venting of excess pressure from a dispenser which includes an air vent passage that is closed when the dispenser is not in operation.

SUMMARY OF THE INVENTION

The present invention provides a dispenser for dispensing different quantities of chemical concentrate into a stream of fluid from a concentrate container at different flow rates. It includes a body member having a through bore with an inlet end adapted to be connected to a source of pressurized liquid at one end and an outlet at the opposite end. A product passage and a vent passage communicate with the through bore. An eductor is mounted in the through bore. A cap member is connected to the body member and a vent member is connected to the cap member.

In a preferred embodiment, the vent member is gas pervious and liquid impervious.

In one aspect, the vent passage is constructed and arranged to be in a closed position when the product passage is closed.

In another aspect, the eductor is both slideable and rotatable, and the dispenser includes a trigger member constructed and arranged to slide the eductor and open the vent passage and includes a seal constructed and arranged to seal both the product passage and the vent passage.

In another preferred embodiment, the eductor is composed of first and second parts, only one of which is rotatable and the first part of the eductor is rotatable and extends from the body member.

In yet another preferred embodiment, a valve member is positioned in the through bore for regulating the flow or water through the through bore and the eductor.

In yet another aspect, the dispenser includes a trigger member connected to the body member and eductor to cause slideable movement of the eductor with the trigger member including a latching mechanism and an essentially flat thumb engaging portion.

A general object of certain embodiments of the invention is to provide a dispensing apparatus which can dispense a wide variety of chemical products.

Another object of certain embodiments of the invention is to provide a dispenser in conjunction with a container wherein the container and the dispensing apparatus are vented.

Still another object of certain embodiments of the invention is to provide a dispenser which is connected to a container wherein excess pressure in the container is vented.

Yet another object of certain embodiments of the invention is to provide a combined dispenser and container which is economical to produce and is dispensable as well as recyclable.

Yet another object of certain embodiments of the invention is to provide a dispenser which can effect a mixing of chemical and concentrate into a stream of water at different concentrations and dispense the mixed concentrate at controlled flow rates.

DESCRIPTION OF THE PREFERRED EMBODIMENTS

Figure 1:
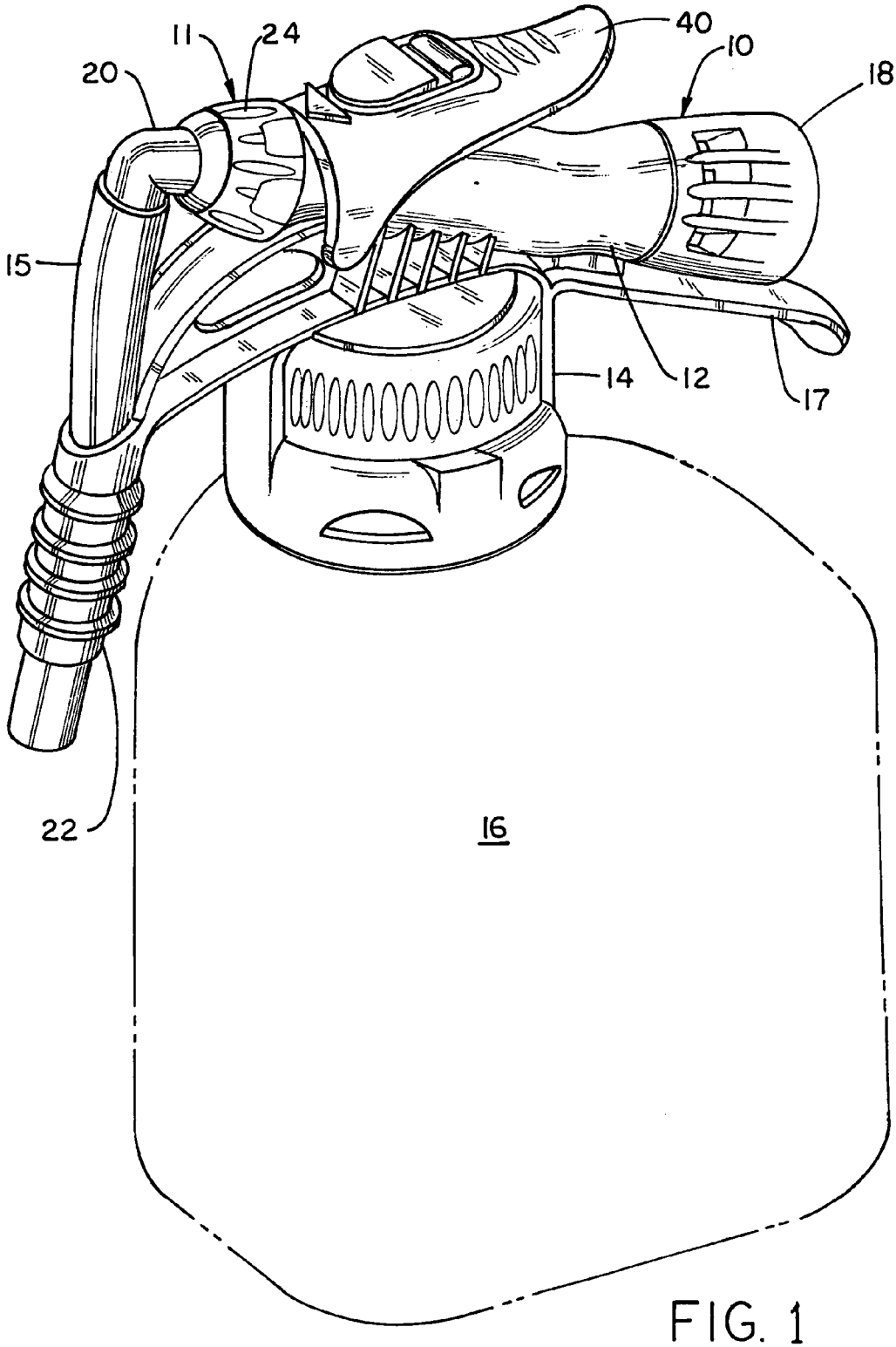
FIG. 1 is a perspective view of the dispenser of this invention in conjunction with a container.
Figure 2:
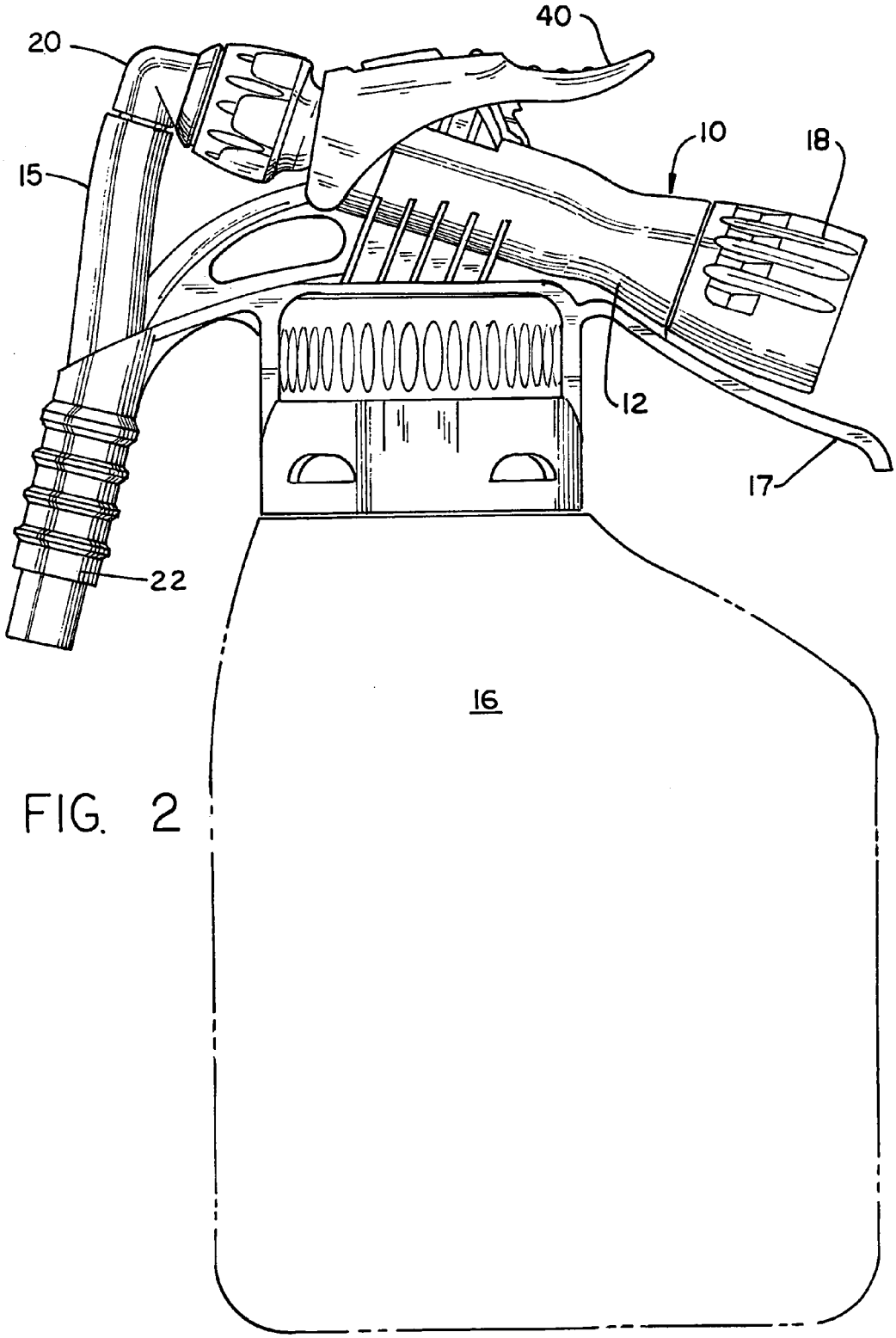
FIG. 2 is a view in side elevation of the dispenser shown in FIG. 1.

Referring to FIGS. 1 and 2, the dispenser generally 10 has a body member 12 with a container connector 14 for connection to a container or bottle 16. A preferred connector system is more fully described in commonly owned patent application U.S. Ser. No. 10/037,569 filed Nov. 9, 2001 which teachings are incorporated herein by reference. At one end of the body member 12 is a hose attachment 18 for supplying pressurized water to the dispenser. A handle 17 is provided below attachment 18. At the other end there is the spout 22 and a nozzle 20 for dispensing a mixed chemical solution. A flexible tube 15 extends between nozzle 20 and spout 22.

Figure 3:
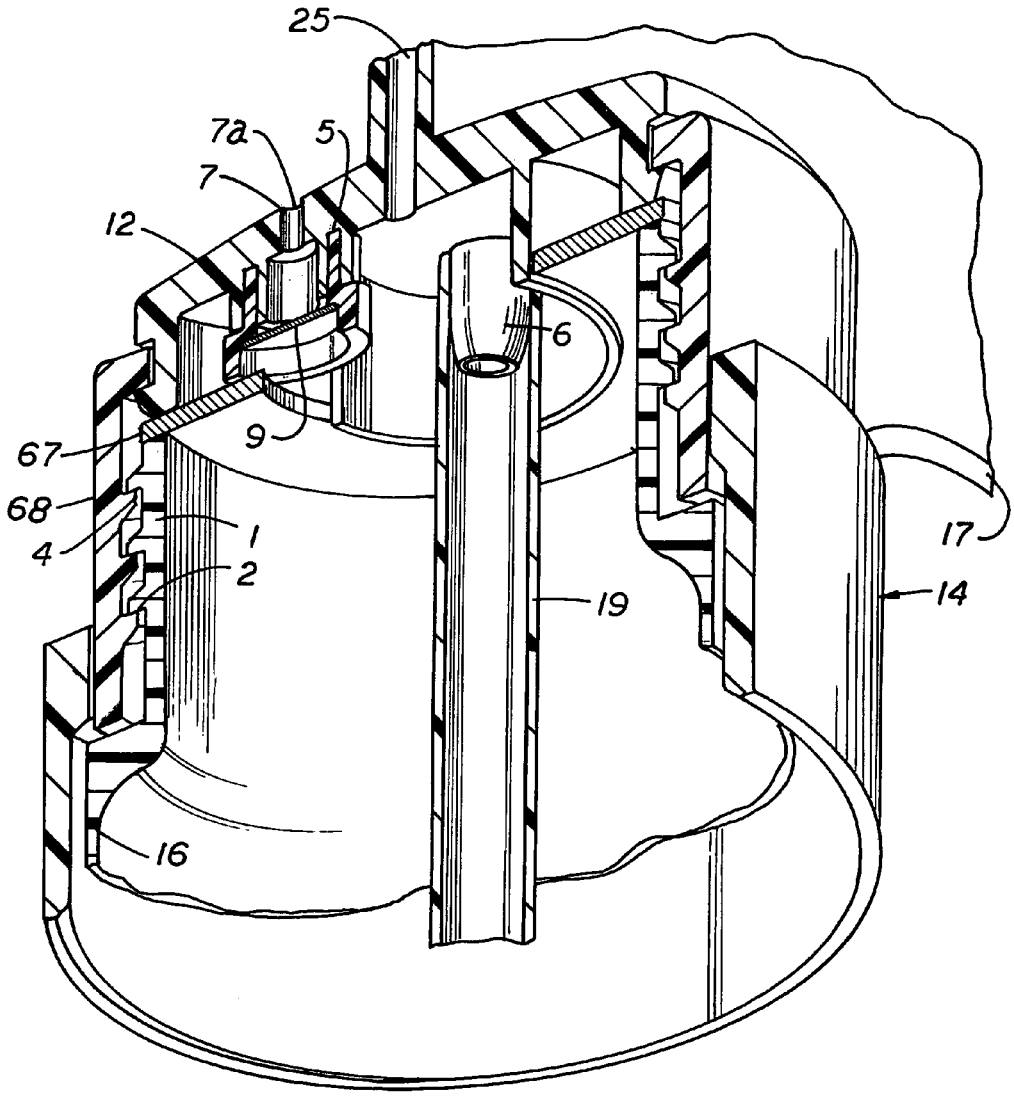
FIG. 3 is a cross-sectional view of the dispenser shown in FIG. 1 illustrating a vent.
Figure 4:
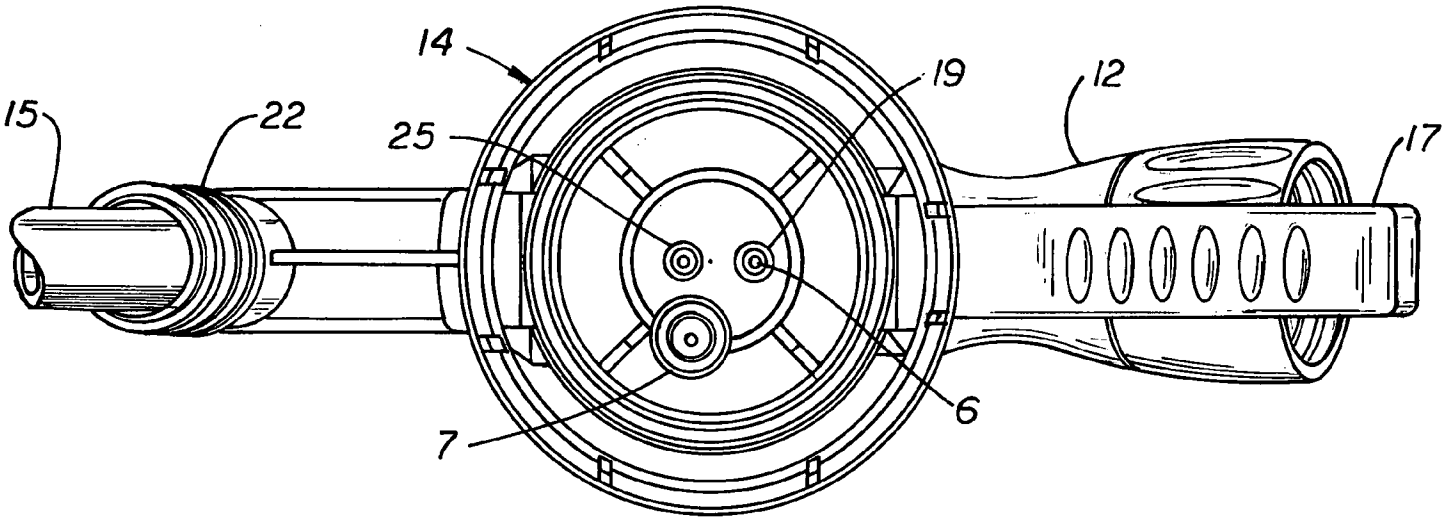
FIG. 4 is a bottom view of the dispenser shown in FIG. 1 illustrating the vent as well as an air passage and the passage for a dip tube.

As seen in FIGS. 3 and 4, there is a nipple 6 which provides connection to a dip tube 19 and an air or vent passage 25. The purpose of these is described later. There is also a vent member 7 which is of the liquid impervious but gas pervious type. It is available from W. L. Gore & Associates GmbH. The purpose is to allow gas to escape from container 16 when it is filled with a disinfectant cleaner which contains hydrogen peroxide. Oxygen gas can evolve and cause a problem with undesired expansion of the container 16. In the instance where chlorine bleach is employed, the evolved gas would be chlorine. Vent member 7 with the micro-porous member 9 is press fitted into the body member 12 by means of collar 5. Vent passageway 7*a* exits to the outside of body member 12 between the ribs 35 as indicated in FIG. 1.

As stated previously, the container connector 14 for connecting the body member 12 to the container 16 is more fully described in patent application U.S. Ser. No. 10/037,569. It includes a fastening member or cap 68 with threads 4 for connection to the threads 2 on the bottle neck 1. A gasket 67 is preferably placed between the top of the bottle neck 1 and the body member 12.

Figure 5:
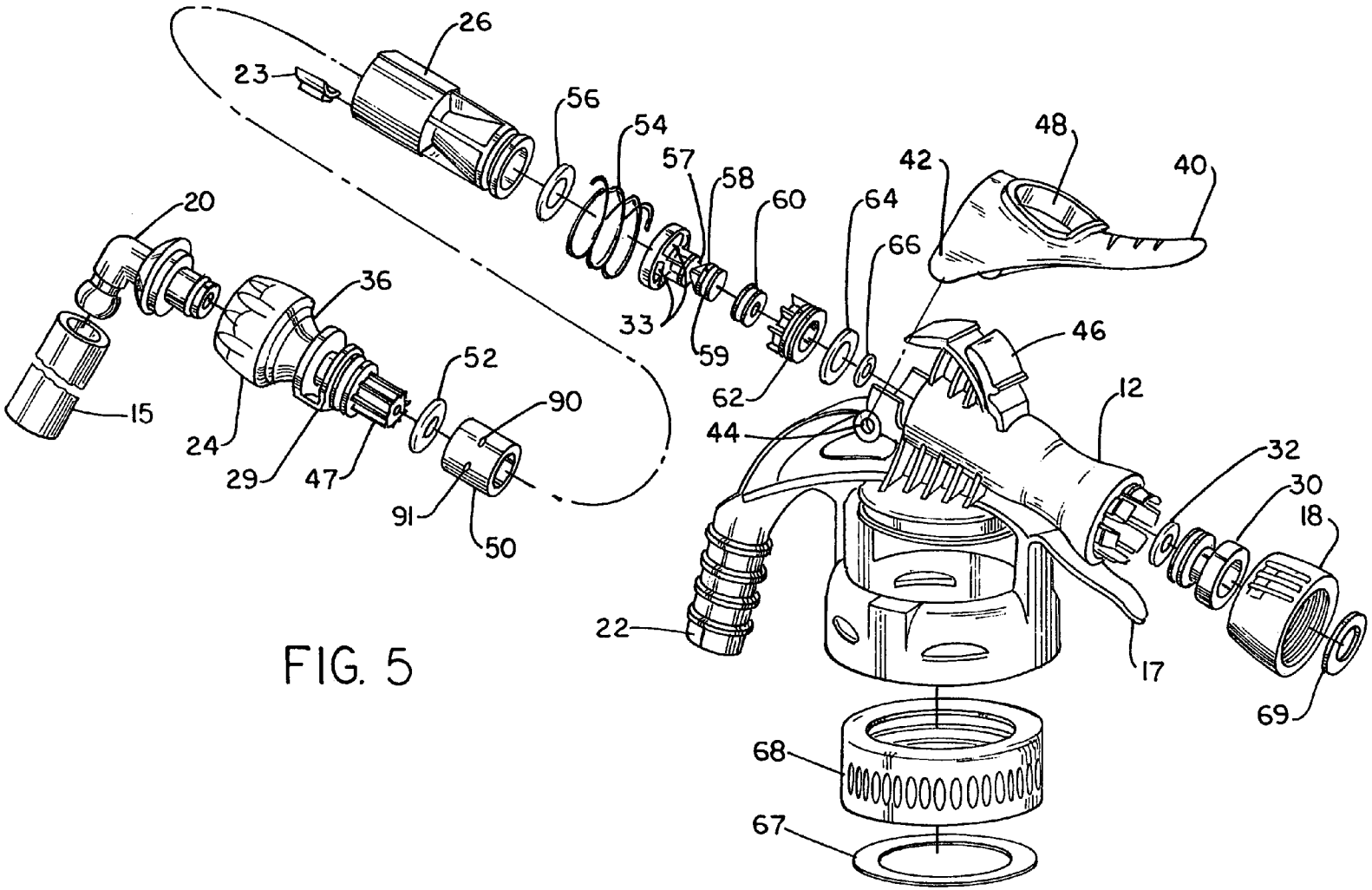
FIG. 5 is an exploded view of the component parts of the dispenser.
Figure 6:
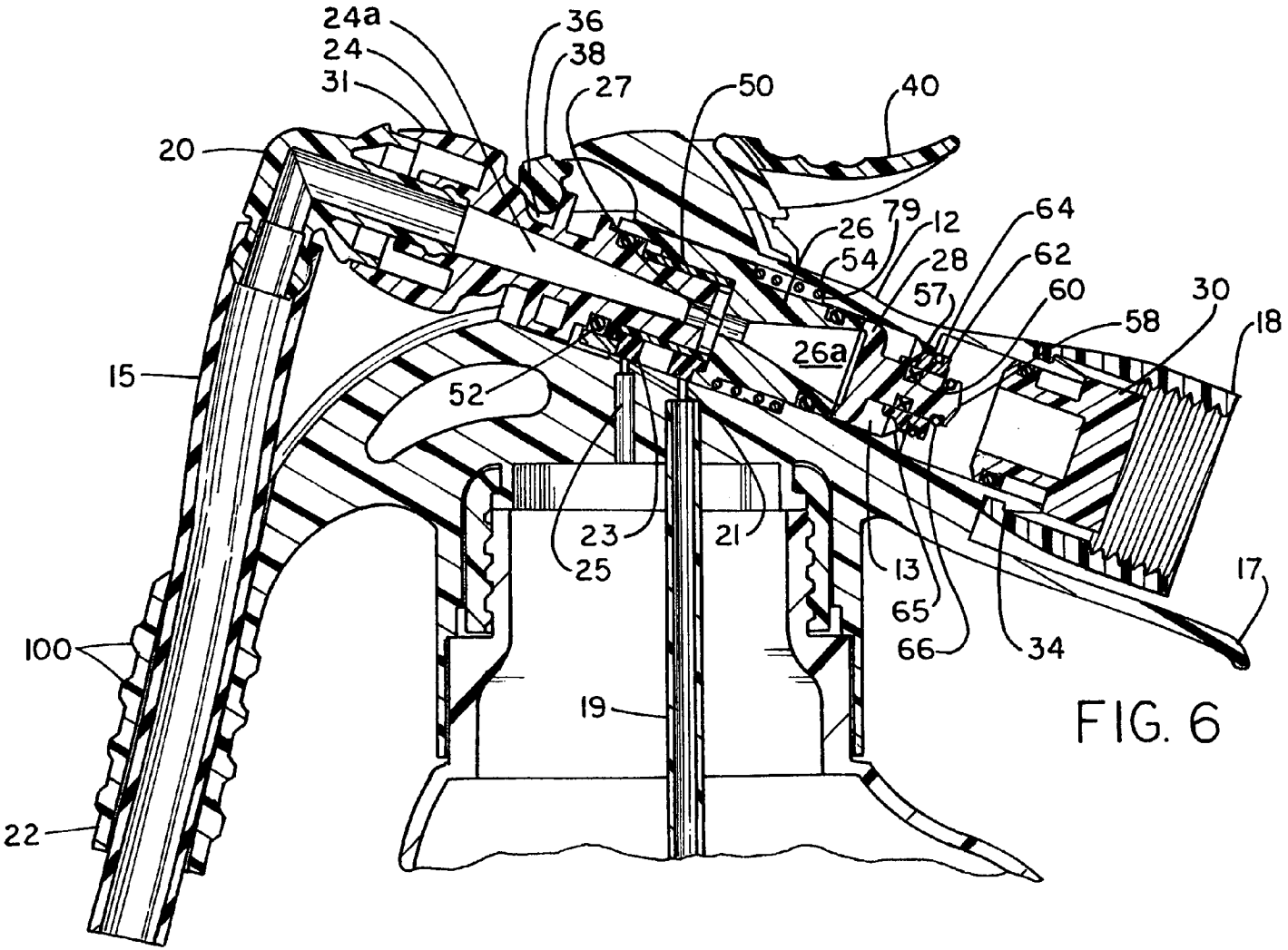
FIG. 6 is a cross-sectional view of the dispenser in a closed position.

Referring to FIGS. 5 and 6, the dispenser 10 includes an eductor generally 11 composed of the first or outer eductor part 24 with a diverging passage 24*a* and an inner second eductor part 26 with a converging passage 26*a*. They are slideably connected in body member 12 with seals 52 and 56 providing a fluid tight contact. A valve assembly 28 for controlling the flow of water through the dispenser 10 is also slideably housed in body member 12 and is in contact with eductor part 26. The hose attachment 18 is rotatably connected to body member 12 by the snap fitment 34. A back flow preventer 30 is positioned in hose attachment 18 and has a seal 32 for contact with body member 12. At the opposite end of body member 12, the nozzle 20 is attached to eductor part 24.

An annular groove 36 is provided in the eductor part 24 and accommodates a head portion 38 of the trigger 40 with flange portions such as shown at 42 on the trigger 40 having shafts (not shown) for extending into bores such as 44. A latch member 46 extends upwardly from the member 12 for fitment through the passage 48 of the trigger 40.

Figure 11:
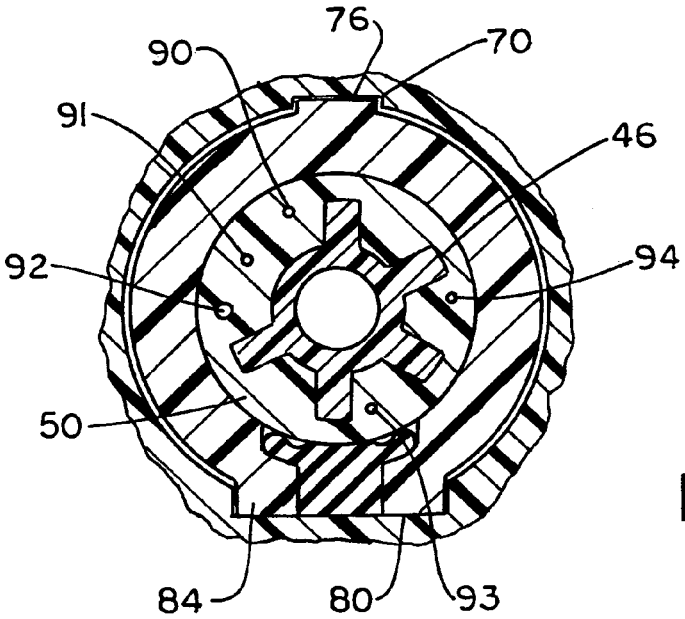
FIG. 11 is a cross-sectional view of the dilution adjustment member utilized in the dispenser.

A dilution adjustment member 50 is connected to the eductor part 24 by means of the splines 47. This is shown in FIG. 11. It has L-shaped passages 90–94 for introducing chemical concentrate into the gap 27 between eductor parts 24 and 26. These passages 90–94 have different diameters or widths for metering different concentrations of chemical concentrate. In some instances there are no passages to provide a rinse function. A dip tube 19 is connected to body member 12 and extends into container 16 for siphoning chemical concentrate into the bore 13 of body member 12 by way of passage 21. The nipple 19 depicted in FIG. 3 is not shown in FIGS. 4–8, nor is the gasket 8. A seal member 23 is placed between dilution adjustment member 50 and body member 12. A vent passage 25 connects container 16 and bore 13. The adjustment member 50 is positioned inside eductor 26. A spring 54 biases eductor part 26 as well as eductor part 24 toward the head portion 38 of trigger 40.

A quad O-ring 60 is attached in groove 57 of valve head portion 58. It serves as a flow control element as later explained. A valve member 28 with passages 33 has a head portion 58 with groove 59. A seal 66 is seated in groove 59 of head portion 58 and another seal 64 is placed on collar 62. A gasket 67 is provided for cap 68 and a hose seal is provided at 69.

Figure 10:
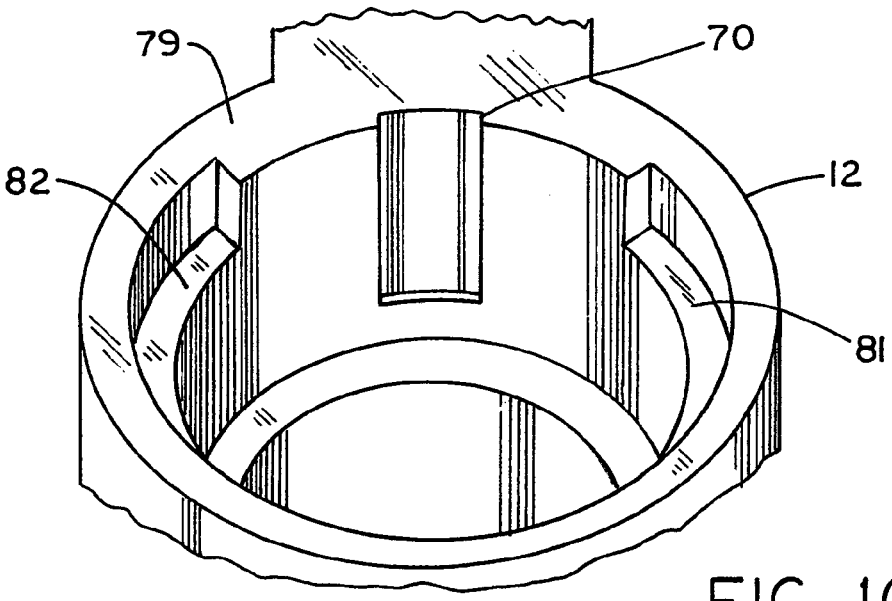
FIG. 10 is a fragmentary view of the dispenser housing illustrating the eductor contact surfaces for limiting the movement thereof.
Figure 12:
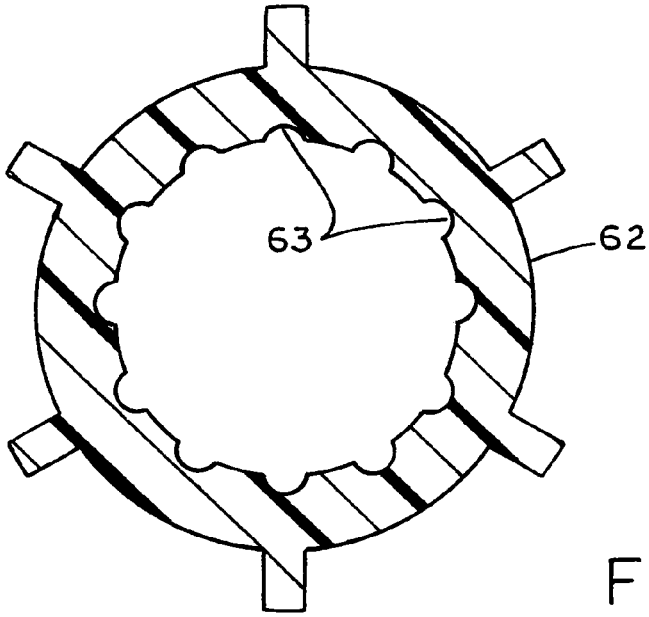
FIG. 12 is a cross-sectional view of a component of a flow control device employed in the dispenser.

Referring to FIG. 10, it is seen that body member 12 has a surface 79 for contact with contact member 29 of eductor 24 as well as a grooves 81 and 82 for the purpose of linearly positioning the eductors 24 and 26 and accordingly valve assembly when trigger 40 is depressed. A keyway 70 is disposed in body member 12 for accommodating a key member 76 (see FIG. 11) in eductor part 26 for allowing sliding but non-rotatable connection in body member 12. A second opposing keyway 80 is also disposed in body member 12 in conjunction with key member 84.

Figure 9:
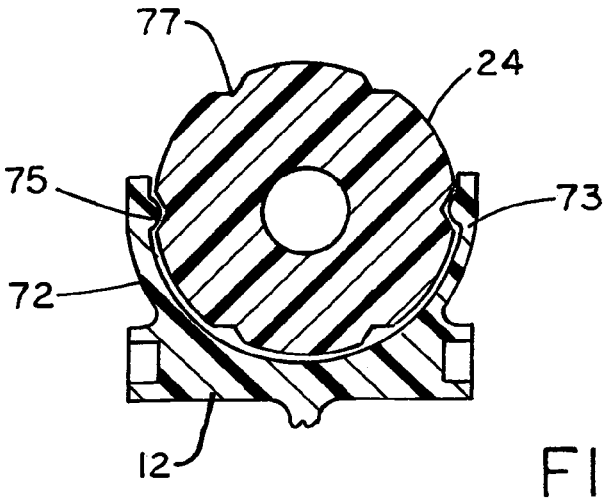
FIG. 9 is a cross-sectional view illustrating an indexing of an eductor in the dispenser.

Referring to FIG. 9, there is shown the eductor 24 with notches 77. These accommodate the projections 75 on arms 72 and 73 extending from body member 12. This provides an indexing function in conjunction with the orientation of dilution adjustment member 50 and passage 21.

OPERATION

A better understanding of the dispenser will be had by a description of its operation. Referring to FIG. 6, the dispenser is shown in a closed position. A source of pressurized water, such as a hose, will have been connected to hose attachment 18. In this instance, seal 66 on valve head 58 is seated against collar 62 and seal 64 against valve seat portion 65. Accordingly, no water can pass between these two components and into bore 13. This sealing effect is assisted by the flow of water in through the attachment 18, against the valve components 58 and 62. The spring 54 and force of water also positions the head 31 of eductor part 24 away from body contact surface 79.

Figure 7:
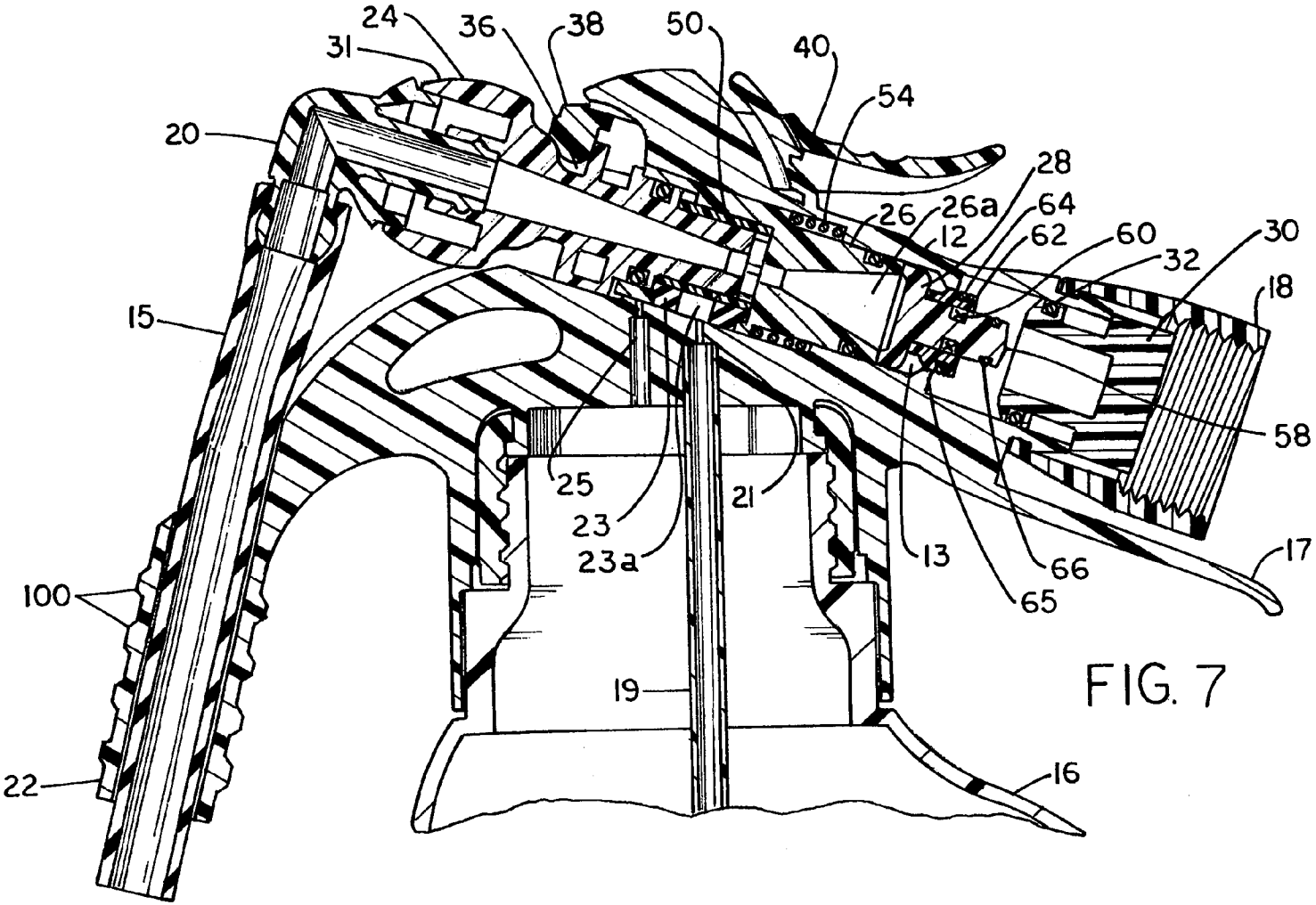
FIG. 7 is a view similar to FIG. 4 showing the dispenser in a low flow condition.

Referring now to FIG. 7, trigger 40 has been moved toward body member 12 with the result that eductor head 31 is contacting surface 79 of body member 12. Valve portion 58 has moved toward the attachment 18 and seal 66 no longer engages collar 62. In this position, water can flow between the two component parts as there are grooves 63 placed in the collar 62 to allow such flow into bore 13. This is a low flow condition. In this position, the quad O-ring 60 serves as a flow control element, in that, with increased pressure and flow of water, the ring will expand and partially fill the grooves 63. This maintains a consistent flow rate despite variations in the pressure of the inlet water supply. Water can then pass through passages 33 and into passage 26*a* of eductor part 26.

Figure 8:
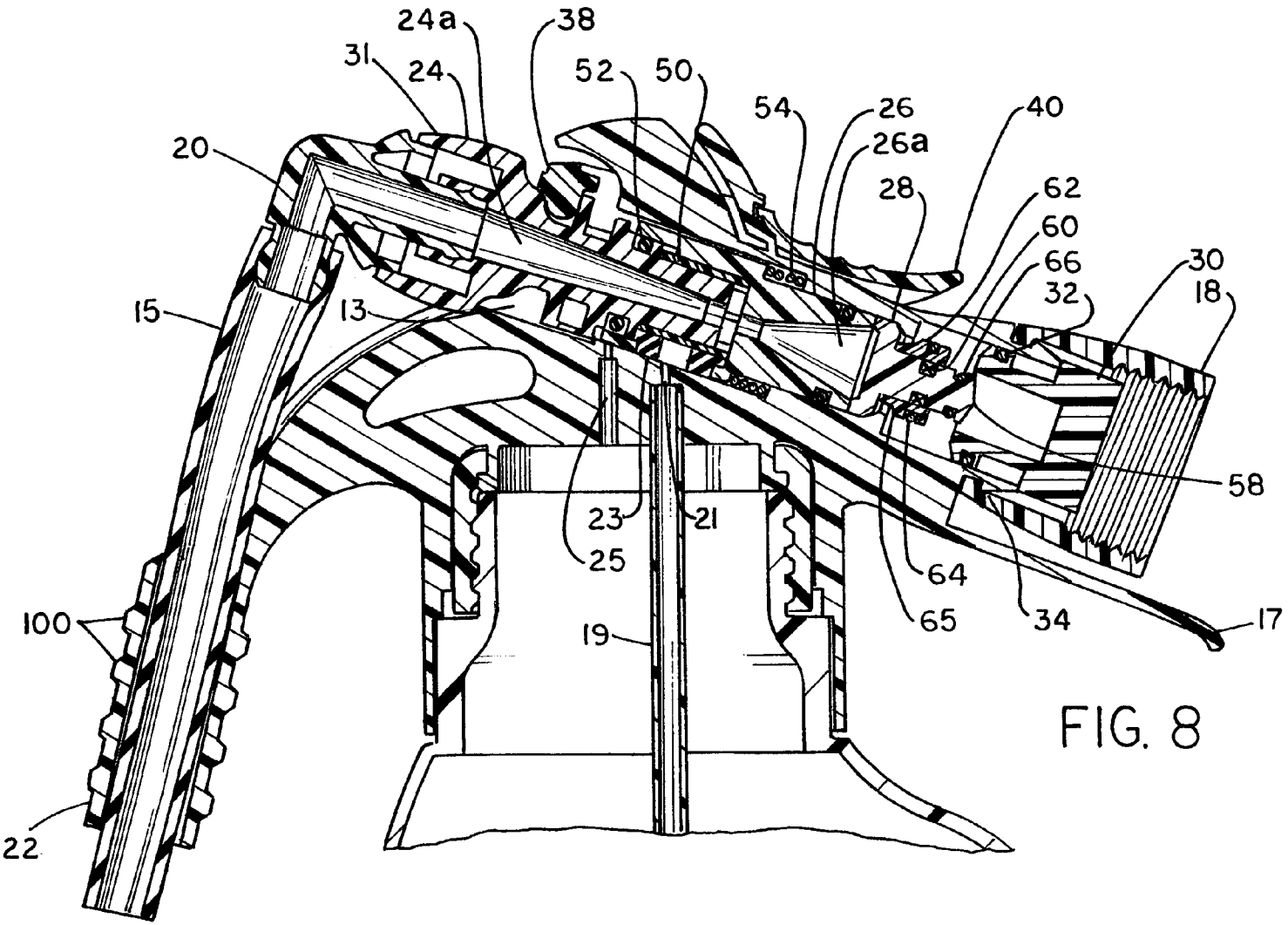
FIG. 8 is a view similar to FIG. 4 showing the dispenser in a high flow condition.

In order to initiate a high flow condition, the trigger 40 is moved further toward body member 12. This is shown in FIG. 8. In this position, not only has seal 66 moved away from collar 62, but collar 62 also has moved away from valve seat portion 65. In this position, water cannot only flow from between head portion 58 and the grooves 63 in the collar 62, but also between the collar 62 and the valve seat portion 65. It should be pointed out that in this high flow position, trigger 40 can now become engaged with latch 46 if desired so that it can be held in the high flow condition. Referring again to FIG. 10, the contact member 29 of eductor part 24 will now engage the grooves such as 81 or 82 so as to allow the eductor parts 26 and 24 to be moved further inwardly into the body 12.

During the previously described flow conditions through the dispenser 10 such as when in the high or low flow condition, the concentrate will be drawn upwardly from the container 16 such as through the dip tube 19. However, as noted previously in FIG. 6, there is a seal member 23 positioned over the passage 21 so that no product can be drawn up from the container 16. At the same time, seal 23 also closes vent passage 25. As seen in both FIGS. 7 and 8, the seal member 23 has moved away from both the product and vent passages 21 and 25, respectively. In this position, drawn product is allowed to enter into one of the five passages 90, 91, 92, 93 and 94 of dilution adjustment member 50 as seen in FIG. 10. Concentrate is thereby siphoned into gap 27 and mixed with water flowing through passage 26*a* and 24*a*. A reduced pressure is caused by the water converging in passage 26*a* and diverging in passage 24*a*.

The orientation of the various passages 90–94 with the opening 23*a* in seal 23 is facilitated by the indexing shown in FIG. 9.

The mixed solution will then exit through nozzle 20, down through the tube 15 positioned in the spout 22. Tube 15 in this instance is flexible so as to allow the eductor 24 to move inwardly and outwardly from the body member 12. With product passing through tube 15 and spout 22, this is the position which is utilized when filling a bucket or a bottle. As previously described a low flow condition would be utilized for filling a bottle while the high flow condition would be utilized to fill a large vessel such as a bucket. The spout 22 provides for the dispenser to be hung on a bucket. If desired, a hose (not shown) can be connected to spout 22 for filling purposes such as a "scrubber washer" or when the dispenser is mounted to a wall. Dispenser 10 can easily be converted to a spray unit by the replacement of the nozzle 20 and the attachment of a conventional spray head (not shown). Also stated previously, the concentration of the solution can be easily adjusted by the rotation of the eductor 24 in conjunction with the dilution adjustment member 50. The low and high flow condition in combination with the dilution adjustment member obviates the use of multiple dispenser heads.

It will thus be seen that there is now provided a very versatile dispenser which can be utilized in not only a high and a low flow condition but also can be adjusted to vary the concentration of mixed solution. The dispenser 10 is produced economically so that once it is captively connected to a container, it is disposable.

It will also be seen that a good hand feel is provided by dispenser 10. This is accomplished by placement of the handle 17 beneath body member 12 and outwardly from trigger 40 to allow placement of a thumb on trigger 40.

It will be seen that there is now provided a very versatile dispenser 10 which can be utilized with both chemical concentrates which produce pressure build up in the container 16 and those that do not. Any excess pressures are relieved through the vent member 7. It should be noted that vent 7 is always in a gas open position even though the air vent passage 25 is closed as seen in FIG. 6. The dispenser can also be utilized not only in a high and low flow condition, but also can be adjusted to vary the concentration of mixed solution. The dispenser 10 is produced economically so that once it is captively connected to a container, it is disposable and/or recyclable. As indicated in the drawings, most of the components are composed of a molded plastic with polypropylene being preferred. This affords a living hinge feature for latch member 46 in trigger passage 48.

The dispenser 10 with the venting feature has been described in conjunction with the dispenser described in U.S. Pat. No. 6,708,901. This venting feature is also operable with the "Improved Multiple Function Dispenser" described in U.S. patent application Ser. No. 10/658,496 filed Sep. 9, 2003.

The dispenser 10 has been preferably described in conjunction with a latching feature for the trigger 40. It is obvious that this is not an essential feature that can be eliminated. Neither is it essential that a back flow preventer be employed in the unit itself. This could be accomplished upstream in a supply line. Further, while the spout 22 offers the advantage of a hose attachment such as with the barbs 100, this could be eliminated although it does further offer the advantage of a bucket attachment. Neither is it essential that the container connector 14 provides a captive use of the dispenser with the container. The dispenser 10 could be utilized with a refillable container. While dilution adjustment member 50 has been shown to have five passages, the number can vary from a single passage to as many as can be practically manufactured. In some instances, it may be desirable to limit the dispenser for flow through a single passageway. This could be accomplished by placement of a pin through body member 12 and a groove in eductor part 24. All such and other modifications within the spirit of the invention are meant to be within a scope as defined by the appended claims.

What is claimed is:

1. A dispenser for dispensing different quantities of chemical concentrate into a stream of fluid from a concentrate container comprising:

a body member having a through bore with an inlet end adapted to be connected to a source of pressurized fluid at one end and an outlet at the opposite end, the body member being connected to the container;

a product passage and a vent passage communicating with the through bore and the container;

an eductor mounted in the through bore; and a vent member, having a passageway in communication with the atmosphere, connected to the body member and the container, independently of the vent passage;

whereby both the vent passage and the vent member are vented through the body member.

2. The dispenser of claim 1 wherein the vent member is gas pervious and liquid impervious.

3. The dispenser of claim 1 wherein the vent passage is constructed and arranged to be in a closed position when the product passage is closed.

4. The dispenser of claim 1 wherein the eductor is both slideable and rotatable.

5. The dispenser of claim 1 further including a trigger member constructed and arranged to slide the eductor and open the vent passage.

6. The dispenser of claim 5 further including a seal constructed and arranged to seal both the product passage and the vent passage.

7. The dispenser of claim 1 wherein the eductor is composed of first and second parts, only one of which is rotatable.

8. The dispenser of claim 7 wherein the first part of the eductor is rotatable and extends from the body member.

9. The dispenser of claim 1 further including a trigger member connected to the body member and eductor to cause slideable movement of the eductor.

10. The dispenser of claim 9 wherein the trigger member includes a latch member.

11. The dispenser of claim 1 further including a valve member positioned in the through bore for regulating the flow of water through the through bore and the eductor.

12. The dispenser of claim 5 wherein the trigger member includes an essentially flat thumb engaging portion.

13. The dispenser of claim 12 wherein the inlet includes a hose engaging member extending over a portion of a handle.

14. A method of venting a gas from a container employing the dispenser of claim 1.

* * * * *